US007060211B2

(12) United States Patent
Oda

(10) Patent No.: US 7,060,211 B2
(45) Date of Patent: Jun. 13, 2006

(54) YAM AND CLOTHS MADE MAINLY FROM BAMBOO SHEATHS AND METHODS FOR MANUFACTURING THE SAME

(75) Inventor: Tomonaga Oda, Fukuoka (JP)

(73) Assignee: Katsuyama Technos Ltd., Miyako-Gun (JP)

( * ) Notice: Subject to any disclaimer, the term of this patent is extended or adjusted under 35 U.S.C. 154(b) by 322 days.

(21) Appl. No.: 10/222,839

(22) Filed: Aug. 19, 2002

(65) Prior Publication Data

US 2003/0056484 A1 Mar. 27, 2003

(30) Foreign Application Priority Data

Sep. 19, 2001 (JP) ..... 2001-285043
Feb. 28, 2002 (JP) ..... 2002-054010

(51) Int. Cl.
*D01F 2/04* (2006.01)
*D01F 2/10* (2006.01)

(52) U.S. Cl. ..... 264/103; 264/189; 264/194; 264/199

(58) Field of Classification Search ..... 264/187, 264/103, 147, 189, 194, 199
See application file for complete search history.

(56) References Cited

U.S. PATENT DOCUMENTS

| | | | | |
|---|---|---|---|---|
| 3,969,268 | A * | 7/1976 | Fukuda et al. | 502/425 |
| 4,366,085 | A * | 12/1982 | Ikegami et al. | 502/155 |
| 4,368,078 | A | 1/1983 | Angelini | |
| 4,891,096 | A * | 1/1990 | Akkawi | 162/1 |
| 5,626,810 | A * | 5/1997 | Zikeli et al. | 264/187 |
| 6,631,862 | B1 * | 10/2003 | Schilling et al. | 241/74 |
| 6,682,673 | B1 * | 1/2004 | Skwiercz et al. | 264/128 |
| 6,720,057 | B1 * | 4/2004 | Neumayr et al. | 428/92 |

FOREIGN PATENT DOCUMENTS

| | | |
|---|---|---|
| GB | 2251 002 A | 6/1992 |
| JP | 123677 | 2/1938 |
| JP | 56-2301 | 1/1981 |
| JP | 4-216007 | 8/1992 |
| JP | 5-239791 | 9/1993 |
| JP | 9-309971 | 12/1997 |
| JP | 11-56560 | 3/1999 |
| JP | 11-147211 | 6/1999 |
| JP | 11-246257 | 9/1999 |
| JP | 2000-226720 | 8/2000 |
| JP | 2000-229661 | 8/2000 |

(Continued)

OTHER PUBLICATIONS

Internet website "What does a clumping bamboo during the seasons of the year?" Bamboo Texas, www.bambootexas.com/YearRound.htm, 2005.*

(Continued)

*Primary Examiner*—Mark A. Osele
(74) *Attorney, Agent, or Firm*—Westerman, Hattori, Daniels & Adrian, LLP

(57) ABSTRACT

The present invention provides yarn and cloths made by utilizing bamboo fiber and methods for manufacturing these yarn and cloths, thereby the bamboo fiber can be utilized by being extracted from sheaths of bamboo shoots or bamboo sheaths that generate at the root of bamboo abundantly, which have been left as they are or mostly disposed of as wastes. By fibrillating or chemically treating bamboo sheaths 10 which is a main raw material, bamboo fiber 16 mainly comprising cellulose is obtained, and then it is formed into yarn by spinning. A cloth is produced as woven or knitted fabric using the yarn.

4 Claims, 2 Drawing Sheets

FOREIGN PATENT DOCUMENTS

| | | |
|---|---|---|
| JP | 2001-115347 | 4/2001 |
| JP | 2001-231372 | 8/2001 |
| WO | WO-01/28869 | 4/2001 |

OTHER PUBLICATIONS

Japanese Office Action dated Feb. 22, 2005.

* cited by examiner

YAM AND CLOTHS MADE MAINLY FROM BAMBOO SHEATHS AND METHODS FOR MANUFACTURING THE SAME

BACKGROUND OF THE INVENTION

The present invention relates to yarn made by utilizing natural bamboo sheaths, cloths made of the yarn, and methods for manufacturing these yarn and cloths.

Up to now, utilizing bamboo has been sought because the bamboo has long and straight fiber. However, since the fiber extracted from mature bamboo stalks is too hard and inflexible, the bamboo fiber has been seldom used as a raw material for paper or ligneous boards for construction, and the bamboo as itself has often been used as a material for crafted products and household goods, and as construction materials. On the other hand, just a few of sheaths of bamboo shoots or of bamboo sheaths which generate a lot at the root of the bamboo are used as materials of containers for foods and confectionery, partial materials of hand-held printing tools, sandals etc., and soft parts such as the sheaths of the bamboo shoots are used as a raw material for feeds.

Consequently, the sheaths of the bamboo shoots and of the grown bamboo are often left as compost of bamboo groves or burned, and there has been hardly any use.

SUMMARY OF THE INVENTION

The present invention is achieved in view of the above situation, and aims to provide yarn and cloths made by utilizing bamboo fiber extracted from sheaths of bamboo shoots or bamboo sheaths that generate at the root of bamboo abundantly, which have been left as they are or mostly disposed of as wastes, and methods for producing these yarn and cloths.

Yarn made by utilizing bamboo sheaths according to a first invention for attaining the above object is made mainly from fine bamboo fiber obtained by fibrillating bamboo sheaths (hereafter, simply referred to as bamboo fiber) and is formed by spinning the bamboo fiber. Here, fibrillating means to ravel out the bamboo sheaths, which are materials for fiber, into a form of fiber.

Yarn made by utilizing bamboo sheaths according to a second invention is formed by spinning cellulose fiber obtained by regenerating cellulose in bamboo sheaths by chemical treatment.

By the first and second inventions, the bamboo fiber can be extracted from the sheaths of the bamboo shoots or from the bamboo sheaths that generate abundantly at the root of the bamboo, which have been left as they are or mostly disposed of as wastes, therefore the bamboo sheaths can be used effectively. Moreover, conventional cellulose fibers are made by using pulp that is made from such as conifers which take several decades to regenerate if cut down once. On the other hand, the bamboo sheaths generate every year and even if the sheaths are taken from bamboo groves, there is little effect on the bamboo groves. Therefore, the bamboo sheaths can be a useful substitute for wood.

Further, although the yarn to be a product is made mainly from the bamboo fiber in the first and second inventions, as a case needs, one or more of natural fibers and regenerated fibers that are made from raw materials except the bamboo sheaths and synthetic fibers can be blended with the bamboo fiber at an optional ratio. As natural fibers except bamboo sheaths, cotton, linen, silk, wool, cashmere, alpaca, mohair, angora, camel, Russian sable, guanaco and the like can be used. As regenerated fibers, general viscose rayon, cuprammonium rayon, acetate, triacetate, refined cellulose and the like which are made from raw materials except bamboo sheaths can be used, and as synthetic fibers, nylon, polyester, acrylic fiber and the like can be used.

A cloth made by utilizing bamboo sheaths according to a third invention for attaining the above object is woven fabric or knitted fabric produced by using the yarn according to one of the first and second inventions.

The bamboo fiber has excellent absorbency and is quick-drying to absorb and evaporate water quickly, and when it is formed into a cloth, the cloth has a great breathability. The woven or knitted fabric is used for clothing such as pajamas, stoles, tank tops, blouses, underwear, suits, jackets, socks and baby clothes, and for other purposes except clothing, it is used for sheets, pillow covers, towels, mats, covers of steering wheels and the like. Furthermore, the fabric can be woven or knitted using yarn spun out of the bamboo fiber blended with natural fibers, regenerated fibers made from other raw materials except bamboo, and synthetic fibers.

A method for manufacturing yarn according to a fourth invention for attaining the above object is to produce yarn by spinning bamboo fiber mainly comprising cellulose obtained from bamboo sheaths. Since the bamboo fiber is long, straight, relatively firm, and inflexible, when the fiber is spun into the yarn, the yarn has excellent hygroscopicity, sweat-absorbency, and hardly generates static electricity.

Moreover, the yarn spun out of the bamboo fiber also drapes and forms elegant pleats. Further, the yarn can be spun out of the bamboo fiber easily by hand-spinning or by a spinning wheel such as Jersey wheel and Saxony wheel.

In the method for manufacturing yarn according to the fourth invention, the bamboo sheaths can be fibrillated into the bamboo fiber by one of physical-shock means of a shotblast, a stamper, and a beater. Since the bamboo sheaths are thin and besides, the fiber is aligned in parallel to a certain direction, when the bamboo sheaths are fibrillated by the physical shock, force is given among the fiber and combination of the fiber is raveled out, thereby the fiber is split easily and long bamboo fiber can be extracted efficiently. The shotblast is an apparatus which jets out abrasives by rotating a blade at high speed by means of rotation of a motor. The abrasives sent to the blade are jetted out to hit against the bamboo sheaths by the high-speed rotating blade so that the bamboo sheaths may be fibrillated. The stamper is an apparatus wherein a thick wooden rod moves up and down for fibrillation. The beater is a semi-continuous apparatus such as Hollander beater, wherein a big roller having a steel-made blade rotates, thereby the bamboo fiber is beaten by strong compressing and shearing forces between the roller and a fixed blade disposed underneath. Accordingly, by using the shotblast, the stamper, and the beater, the bamboo fiber can be extracted long as it is without being cut small.

Furthermore, in the method for manufacturing yarn according to the fourth invention, the bamboo fiber can be spun into the yarn after being swelled and softened by boiling. By boiling, the bamboo fiber, which has been difficult to use because of its hardness and inflexibility, becomes flexible and easy to be spun. In addition, the boiled bamboo fiber is preferably washed in water and selected carefully before spinning. Further, a small quantity of an alkaline agent can be added to the boiling water. Thereby, more flexibility can be given to the bamboo fiber. As the alkali, sodium carbonate anhydrous, sodium hydroxide and the like can be used, and consequently, spinning becomes easier.

A method for manufacturing yarn according to a fifth invention is a concrete method of the method for manufacturing yarn according to the fourth invention, wherein viscose obtained by treating the bamboo sheaths mainly comprising cellulose with an alkaline agent (for instance, sodium hydroxide) and carbon disulfide is forced through small holes into a hardening bath to regenerate cellulose fiber, and the cellulose fiber is spun into the yarn. By forming the naturally short bamboo fiber as the viscose, long fiber can be regenerated from the viscose. Here, the hardening bath is preferably a bath of sulfuric acid. Additionally, regenerated cellulose fiber thus manufactured is generally called viscose rayon. Although conventional viscose rayon is made from wood pulp, by using the bamboo fiber, the bamboo sheaths which have been mostly disposed of can be utilized advantageously. Furthermore, the viscose rayon is a fiber which is easy to dye and highly absorbent.

A method for manufacturing yarn according to a sixth invention, which is a concrete method of the method for manufacturing yarn according to the fourth invention, comprises steps of treating the bamboo sheaths mainly comprising cellulose with ammonia and basic copper sulfate then treating the sheaths with an alkali to obtain a solution of cuprammonium cellulose, forcing the solution of cuprammonium cellulose through small holes, bringing the ejected solution into contact with water to remove ammonia, further bringing the ejected solution into contact with an aqueous solution of sulfuric acid to remove copper and to form cellulose fiber, and spinning the cellulose fiber into the yarn. Here, warm water can be used instead of water. Regenerated cellulose fiber thus manufactured is generally called cupra. The cupra is a flexible and highly elastic fiber, and wrinkles less than the viscose rayon.

A method for manufacturing yarn according to a seventh invention, which is a concrete method of the method for manufacturing yarn according to the fourth invention, comprises steps of dissolving the bamboo sheaths mainly comprising cellulose in tertiary amine N-oxide, preferably in N-methylmorpholine-N-oxide, forcing the dissolution through small holes into a hardening bath to refine or make cellulose fiber without chemical reactions, and spinning the cellulose fiber into the yarn. Accordingly, decrease in polymerization degree of cellulose molecules is small, and the yarn is strong. Refined cellulose fiber thus manufactured is called lyocell. Although conventional lyocell is made from wood pulp, by using the bamboo fiber, the bamboo sheaths can be used advantageously. Further, N-methylmorpholine-N-oxide to be used is non-toxic to humans and a recycle system can be built for all the organic solvents used to be collected and recycled.

Moreover, the lyocell is a fiber having a flexibility to drape, graceful and subdued luster, soft texture, depth in color, great dimensional stability and washability.

A method for manufacturing yarn according to an eighth invention, which is a concrete method of the method for manufacturing yarn according to the fourth invention, comprises steps of pretreating the bamboo sheaths mainly comprising cellulose with acetic acid, acetylating the sheaths with acetic anhydride and acetic acid in the presence of sulfuric acid as a catalyst to form acetate fiber, and spinning the acetate fiber into the yarn. The semi-synthetic cellulose fiber comprises cellulose triacetate (triacetate) of which all three hydroxyl groups in glucose unit are substituted to acetyl groups, and secondary cellulose acetate (diacetate or simply acetate) obtained by hydrolyzing the triacetate partially to reconvert part of the acetyl groups into the hydroxyl groups. The cellulose triacetate and secondary cellulose acetate are called acetate fiber. By regenerating the bamboo fiber as the acetate fiber, yarn which takes color well and has dry texture can be manufactured. Further, the triacetate is dissolved in such as methylene chloride and dichloromethane, then dry spun. Moreover, the diacetate is dissolved in acetone and dry spun. Although conventional acetate fiber is made from cotton linters and wood pulp, by utilizing the bamboo fiber, resources can be saved. Further, the acetate fiber is a fiber having graceful luster like silk.

A method for manufacturing cloth according to a ninth invention is to form a cloth out of the yarn manufactured by the methods for manufacturing yarn according to the fourth through eighth inventions by using a loom. Thereby, since the cloth is formed by using the yarn made mainly from bamboo sheaths, a woven fabric with a new appearance and texture can be obtained. Furthermore, the fabric has excellent absorbency and is quick-drying as characteristics of the bamboo fiber, and when processed as viscose rayon, the fabric has excellent dye-ability and absorbency, as cupra, it has flexibility, elasticity and hardly becomes wrinkled, as lyocell, it has flexibility to drape, graceful and subdued luster, soft texture, depth in color, great dimensional stability and washability, as acetate, it has graceful luster like silk. The cloth can be manufactured by selecting the most suitable yarn having such characteristics according to the use.

DESCRIPTION OF THE PREFERRED EMBODIMENT

Next, a preferred embodiment of the present invention will be described hereunder with reference to the accompanying drawings for the present invention to be understood.

Figure 1:
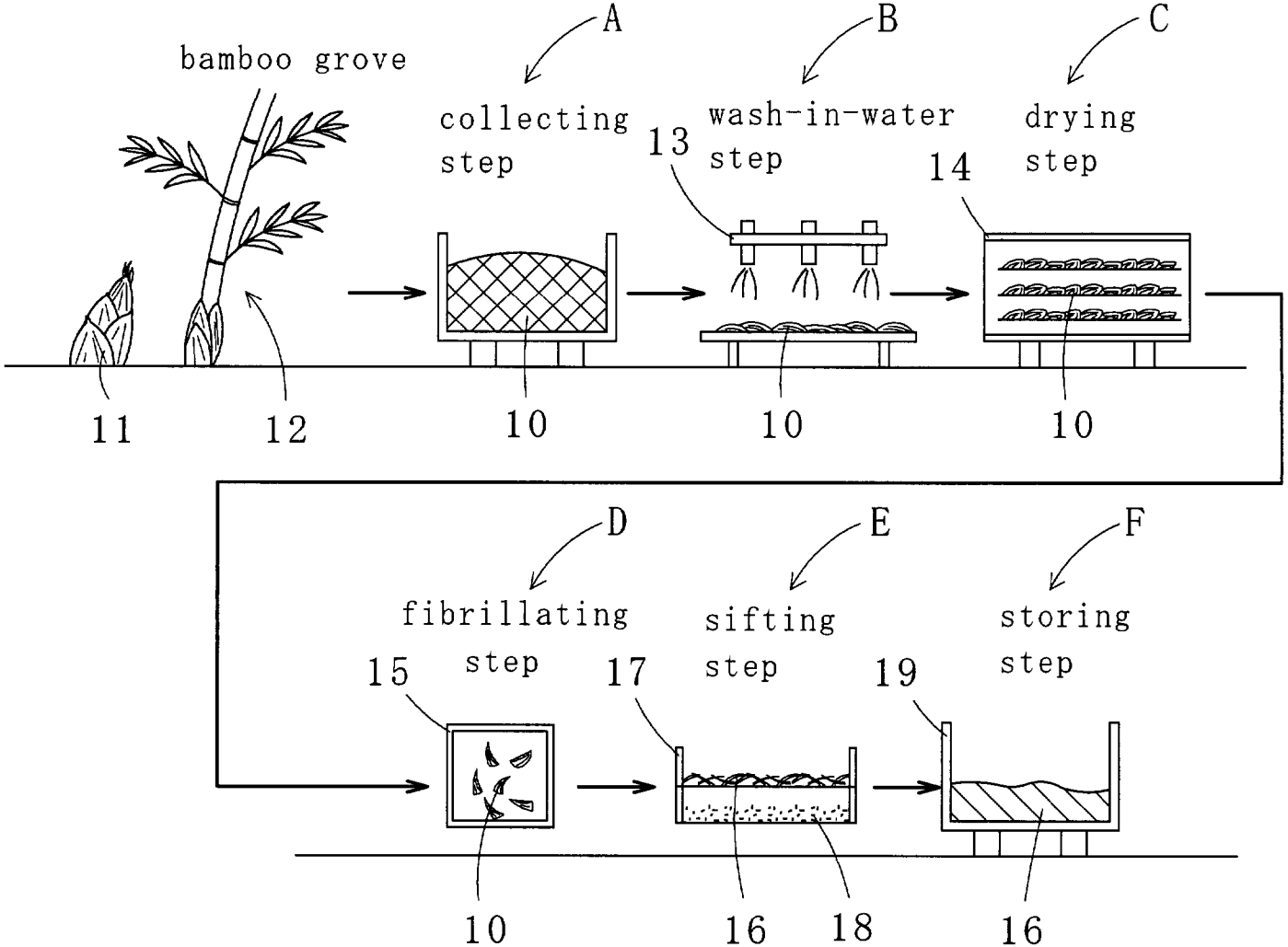
FIG. 1 is an explanatory diagram of a manufacturing process of bamboo fiber to be a main raw material for yarn made by utilizing bamboo sheaths according to a first embodiment of the present invention.

As shown in FIG. 1, manufacture of bamboo fiber 16 to be a main raw material for yarn made by utilizing bamboo sheaths according to a first embodiment of the present invention starts with using sheaths of a bamboo shoot 11 and sheaths generated at a root of a bamboo 12 as bamboo sheaths 10 for a raw material. Accordingly, the manufacture starts from collecting step A where the bamboo sheaths are collected from such as bamboo groves, vegetable markets, and fruit and vegetable shops. Further, types of the bamboo from which the bamboo sheaths 10 are obtained are not limited specifically, however, *Phyllostachys bambusoides, Phyllostachys pubescens, Phyllostachys nigra* var. *henonis, Phyllostachys nigra, Pseudosasa japonica, Pleioblastus simonii* and the like are preferably used. In this embodiment, the bamboo sheaths 10 was obtained from *Phyllostachys pubescens*, which is relatively easily available in Japan.

Next, the bamboo sheaths 10 are rinsed with water at wash-in-water step B to remove mud and dust adhered to the surface. In this embodiment, a shower 13 which spouts water was used as means for washing in water, however, the wash can be carried out by immersing the sheaths in a water tank or using a washing machine. Next, the bamboo sheaths 10 washed in water proceed to drying step C. A reason for drying the bamboo sheaths 10 is to make the bamboo sheaths 10 easy to be fibrillated at next fibrillating step D. In this embodiment, a dryer 14 which uses hot wind with a relatively low temperature (for instance, between 50 to 100° C.) is used as means for drying. Furthermore, natural drying by leaving the sheaths in the air or vacuum drying can be employed as other means for drying.

Next, the dried bamboo sheaths 10 proceed to fibrillating step D. The bamboo sheaths 10 whose fiber is aligned in parallel to longitudinal direction thereof are fibrillated by abrasives ejected from a shotblast 15, as one example of physical-shock means, and hit against the bamboo sheaths 10. Except by the shotblast 15, the bamboo sheaths 10 can be fibrillated easily by beating with a wooden rod or using a stamper or a beater such as Hollander beater. Further, in this embodiment, the obtained bamboo fiber 16 is used as it is as fiber. Therefore, using regular fibrillating machines (such as a disc refiner or a conical refiner) is not suitable since the bamboo fiber 16 would become short fiber by being cut irregularly.

Moreover, when a fibrous substance is dissolved to form regenerated cellulose fiber such as viscose or cuprammonium cellulose, or semi-synthetic cellulose fiber such as acetate, bamboo sheaths are preferably cut in a proper size, however, the above fibrillating machines can also be used to make the bamboo sheaths into a state of fiber.

Next, the fibrillated bamboo sheaths 10 proceed to sifting step E to be sifted into the bamboo fiber 16 and fine powder 18 (a powdery substance excluding fiber) by being put through a sieve 17. Although the sieve 17 was used in this embodiment, sifting can be carried out by blowing off the fine powder 18 composed of impurities by blowing a wind. Also, a current of water can be used for sifting. Thickness and length of the sifted bamboo fiber 16 vary with the size of the bamboo sheaths 10 to be used, for example, the fiber of about 0.1 to 0.2 mm in thickness and about 3 to 30 cm in length can be obtained.

The bamboo fiber 16 extracted as above is stored in a container 19 at storing step F.

Next, the bamboo fiber (primary bamboo fiber) 16 is boiled to promote swell of the fiber and washed in water to be produced as secondary bamboo fiber having flexibility. Furthermore, the secondary bamboo fiber is preferably selected carefully prior to use. Here, time for boiling to swell the bamboo fiber 16 is about one to three hours. In this embodiment, the bamboo fiber 16 was boiled for two hours with a little amount of sodium hydroxide added to the boiling water to further promote swell of the fiber and give more flexibility to the fiber. Since the bamboo fiber 16 is strong against alkali, chemical reaction does not occur.

Furthermore, a bleaching agent such as bleaching powder, hydrogen peroxide solution and the like may be added, thereby bleached tertiary bamboo fiber can be obtained. Moreover, the tertiary bamboo fiber is washed thoroughly in a water tank or in running water and squeezed to remove impurities in the fiber.

Next, the secondary or tertiary bamboo fiber is spun into yarn. Although, means for spinning is not limited specifically, considering the flexibility and strength of the secondary and tertiary bamboo fibers, conventional spinning method by hand is preferable. This embodiment also adopted the spinning method by hand. The yarn is woven into a fiber fabric (cloth) by using a loom. As the loom to be used, a handloom is easiest to use considering the flexibility and strength of the yarn. Furthermore, the fabric can be woven out of the yarn solely or a blend of vegetable fibers such as linen or cotton with the yarn. In this embodiment, the fiber fabric is woven by using hemp thread as warp and the yarn spun out of the bamboo fiber as weft. Moreover, the yarn may be knitted into a cloth by hand-knitting or machine-knitting. These methods for forming the yarn into a cloth are applied in the following embodiments of the present invention when the yarn is formed into woven or knitted fabric.

Next, a method for manufacturing yarn made by utilizing bamboo sheaths according to a second embodiment of the present invention will be described referring to FIG. 2. The bamboo fiber 16 mainly comprising cellulose obtained by the manufacturing steps A to F of the first embodiment is soaked in a solution of sodium hydroxide at a proper concentration (15 to 20% in this embodiment) at a temperature between about 20 to 25° C. for one to three hours to form alkali cellulose, then pressed to remove excess solution of sodium hydroxide. The alkali cellulose is crashed by a grinder and left for about one day.

Next, the alkali cellulose is sulfurized by adding carbon disulfide, whose amount is 35% by weight of the alkali cellulose, at a temperature of 20 to 25° C. (room temperature). With the elapse of time, the alkali cellulose is jellied by sulfuration. After performing this treatment for about five to six hours or so, remain of carbon disulfide is removed by evaporation due to decompression, and cellulose sodium xanthogenate is obtained.

Figure 2:
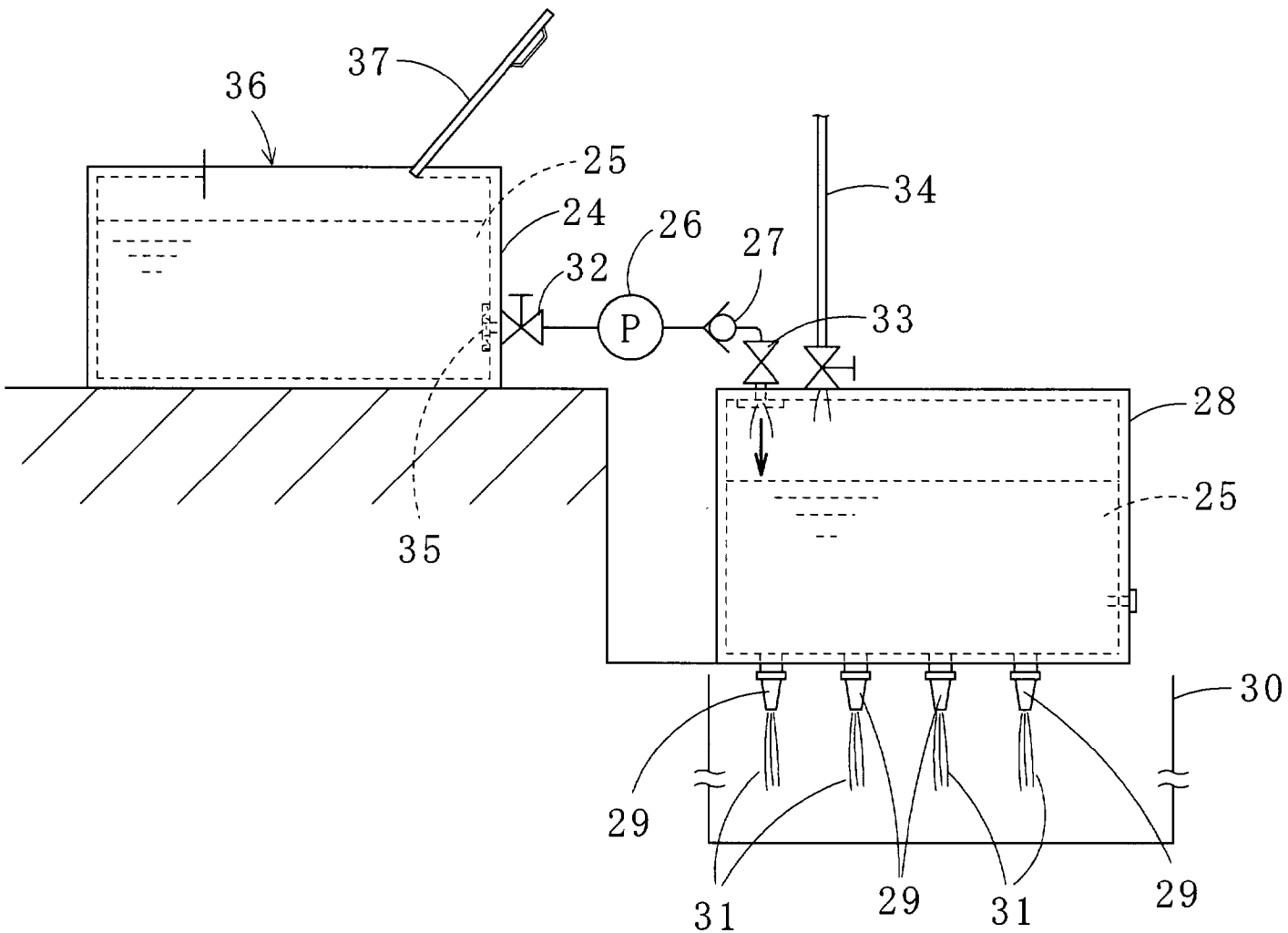
FIG. 2 is an explanatory diagram of an apparatus for manufacturing yarn by utilizing bamboo sheaths according to a second embodiment of the present invention.

A diluted solution of sodium hydroxide is put in a container 24 shown in FIG. 2 and the cellulose sodium xanthogenate is added in. Thereby, the cellulose sodium xanthogenate dissolves in the solution of sodium hydroxide and forms a viscose solution 25. For the viscose solution 25 to contain 3–8% sodium hydroxide and 7–15% cellulose of the bamboo fiber 16, the input of the solution of sodium hydroxide and the cellulose sodium xanthogenate is previously adjusted.

Next, the viscose solution 25 is sent to an airtight container 28 via a pump 26 and a check valve 27. A plurality of nozzles 29 are provided at the bottom of the airtight container 28. Each of the nozzles 29 is provided with a plurality (5 to 20) of small nozzle holes at intervals so that the viscose solution 25 inside the airtight container 28 may be ejected as filaments. Moreover, compressed air is fed to the upper portion of the airtight container 28, so that the inside viscose solution 25 is pressurized and ejected from the nozzles 29.

The viscose solution 25 ejected from the nozzles 29 is led into a deep tub 30. The deep tub 30 is filled with a dilute solution of sulfuric acid as a hardening bath, wherein the viscose solution 25 (cellulose sodium xanthogenate) is hydrolyzed with the dilute sulfuric acid to be reconverted to cellulose and becomes fine and long regenerated cellulose fiber 31 (viscose rayon). Furthermore, in FIG. 2, 32 and 33 are switching valves to transfer the viscose solution 25 from the container 24 to the airtight container 28 via the pump 26, 34 shows a pipe for compressed air, 35 shows a screen for filtration to remove impurities in the viscose solution 25, 36 shows an opening portion of the container 24, and 37 shows a lid thereof.

By spinning the regenerated cellulose fiber 31 after drying, yarn made from bamboo sheaths is manufactured. In addition, the yarn can be spun further to manufacture thicker yarn. Here, the present invention is applicable to a case where not only bamboo sheaths but also other cellulosic ingredients are added as raw materials for a small degree. Furthermore, a cloth can be made out of the yarn as a matter of course, and accordingly, garments can also be sewn from the cloth.

Next, a method for manufacturing yarn made by utilizing bamboo sheaths according to a third embodiment of the present invention will be described. The bamboo fiber 16 mainly comprising cellulose obtained by the manufacturing steps A to F of the first embodiment is added into a cuprammonium solution prepared by basic copper sulfate $CuSO_4 \cdot nCu(OH)_2$ (n=4–6) and concentrated ammonium hydroxide, and stirred. After the cellulose is swelled enough by the cuprammonium solution, the cellulose is dissolved completely with added sodium hydroxide, and then water is added so that the concentration of the cellulose would become 10 to 12%. Solution of cuprammonium cellulose thus manufactured is spun by a stretch-spinning method. In the stretch-spinning method, the solution of cuprammonium cellulose is forced through small holes into warm water, the ejected solution turns into blue fiber on contact with the warm water where ammonia is removed, and further, as the ejected solution comes into contact with an aqueous solution of sulfuric acid where copper is removed, the cellulose fiber is regenerated, and the fiber is spun into the yarn. Furthermore, the yarn can be formed into a cloth as a matter of course, and accordingly, garments can be sewn from the cloth.

Next, a method for manufacturing yarn made by utilizing bamboo sheaths according to a fourth embodiment of the present invention will be described. The bamboo fiber 16 mainly comprising cellulose obtained by the manufacturing steps A to F of the first embodiment is dissolved in N-methylmorpholine-N-oxide, which is an example of tertiary amine N-oxide. At the time of dissolution, a proper amount of hydrogen peroxide is added as a stabilizer to prevent decrease in polymerization degree of the cellulose and decomposition of the N-methylmorpholine-N-oxide. The solution of cellulose ejected from spinning nozzles turns into fine, long refined cellulose fiber (lyocell) on contact with a hardening bath. This refined cellulose fiber is spun into yarn. Furthermore, the yarn can of course be made into a cloth, and accordingly, garments can be sewn from the cloth.

Here, the hardening bath is preferably a mixed solvent of one or more of nonsolvents for cellulose such as water and alcohol like methanol, ethanol and the like, or a mixed solvent of nonsolvents for cellulose and N-methylmorpholine-N-oxide, still preferably, water or a mixed solvent of water and N-methylmorpholine-N-oxide.

Next, a method for manufacturing yarn made by utilizing bamboo sheaths according to a fifth embodiment of the present invention will be described. The bamboo fiber 16 mainly comprising cellulose obtained by the manufacturing steps A to F of the first embodiment is added in acetic acid and stirred, and then acetylated with acetic anhydride and acetic acid in the presence of sulfuric acid as a catalyst to form triacetate. Then, the triacetate is hydrolyzed to obtain diacetate. The diacetate is dissolved in acetone and acetate fiber is produced by a dry-spinning method. Further the triacetate is dissolved in a mixed solvent mainly comprising dichloromethane with alcohol (10–20%), and acetate fiber is produced by a dry-spinning method. Moreover, these acetate fibers are spun into yarn. The yarn can of course be made into a cloth, accordingly, garments can be sewn from the cloth.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

For example, in the above-described embodiments, although the bamboo sheaths are fibrillated by the physical means, fibrillation can be carried out by chemical methods such as boiling with an alkaline solution added or degreasing can be done with such as alcohol before the alkali treatment. Further, the yarn can be manufactured with a small amount of impurities contained naturally in the bamboo sheaths.

Furthermore, although the bleaching agent is added in the manufacturing process of raw fiber in the embodiment, the bleaching can be carried out at an appropriate step, either after the raw fiber is manufactured or after the product is manufactured. Moreover, the bamboo fiber can be made into products with its natural color without bleaching. When the yarn is spun, unevenness or bend can be formed by the shape of the spinneret of the spinning nozzle. Furthermore, when the yarn is formed as hollow yarn having a hollow inside, the yarn can be used as hollow yarn for kidney dialysis to purify blood or to supply oxygen to blood.

What is claimed is:

1. A method for manufacturing yarn, comprising:

a first step of collecting sheaths of bamboo shoots of one of *Phyllostachys bambusoides, Phyllostachys pubescens, Phyllostachys nigra* var, *henonis, Phyllostachys nigra, Pseudosasa japonica* and *Pleioblastus simonii* which have been left as they were or disposed of as wastes;

a second step of drying the collected sheaths of the bamboo shoots using hot wind in a range of 50 to 100° C.;

a third step of fibrillating the dried sheaths of the bamboo shoots into fiber of sheaths of bamboo shoots by one of physical-shock means of a shotblast, a stamper, and a beater; and a fourth step of spinning the yam out of the fiber of the sheaths of the bamboo shoots, wherein fine powder is separated from the fiber of the sheaths of the bamboo shoots fibrillated by the physical-shock means by blowing off the fine powder or using a current of water.

2. The method for manufacturing yam according to claim 1, wherein the fiber of the sheaths of the bamboo shoots is boiled to be swelled and softened before spinning thereof.

3. The method for manufacturing yarn according to claim 2, wherein the boiling is carried out with an alkaline agent added.

4. A method for manufacturing a cloth, wherein the cloth is woven from the yarn manufactured by the method for manufacturing yarn according to claim 1.

* * * * *